United States Patent [19]

van Mensvoort

[11] Patent Number: 4,794,360

[45] Date of Patent: Dec. 27, 1988

[54] INDUCTIVE DEVICE HAVING A CORE OF AN AMORPHOUS MATERIAL

[75] Inventor: Adrianus J. van Mensvoort, Eindhoven, Netherlands

[73] Assignee: U.S. Philips Corporation, New York, N.Y.

[21] Appl. No.: 92,836

[22] Filed: Sep. 3, 1987

[30] Foreign Application Priority Data

Sep. 12, 1986 [NL] Netherlands ..... 8602302

[51] Int. Cl.[4] ..... H01F 17/06; H01F 17/26; H01F 41/02

[52] U.S. Cl. ..... 336/178; 29/609; 336/179; 336/211; 336/213; 336/219

[58] Field of Search ..... 336/165, 178, 211, 198, 336/208, 213, 233, 234, 212, 179, 219; 29/602 R, 605, 606, 607, 609

[56] References Cited

U.S. PATENT DOCUMENTS

| | | | |
|---|---|---|---|
| 2,699,532 | 1/1955 | Bussing | 336/178 X |
| 4,496,925 | 1/1985 | Geschka | 336/178 |
| 4,518,942 | 5/1985 | Geschka | 336/178 |

FOREIGN PATENT DOCUMENTS

| | | | |
|---|---|---|---|
| 969130 | 5/1958 | Fed. Rep. of Germany | 336/165 |
| 2540409 | 11/1978 | Fed. Rep. of Germany . | |
| 148418 | 9/1983 | Japan | 336/213 |
| 1525959 | 9/1978 | United Kingdom . | |

*Primary Examiner*—Thomas J. Kozma

*Attorney, Agent, or Firm*—Bernard Franzblau

[57] ABSTRACT

An inductive device comprising a ferromagnetic core which has two approximately U-shaped core halves (9, 11) connected together with their limbs (9', 11'; 9'', 11'') facing each other so that they enclose a core window (17). Each core half (9, 11) is constructed substantially from a packet of mutually parallel strips of an amorphous ferromagnetic material. Filling members (21', 21'') consisting of a solid non-ferromagnetic material are placed between the free ends of each pair of facing limbs (9', 11'; 9'', 11''), and in the space (23', 23'') between the ends the filling members extend from the core window (17) in the outward direction over at most half of the width of the core limbs. A decrease of the magnetic permeability of the core material as a result of decreasing temperature is compensated by a decrease of the width of the air gaps (23', 23'') between the free ends of the limbs (9', 11'; 9'', 11'').

4 Claims, 2 Drawing Sheets

INDUCTIVE DEVICE HAVING A CORE OF AN AMORPHOUS MATERIAL

BACKGROUND OF THE INVENTION

This invention relates to an inductive device comprising a ferromagnetic core having two approximately U-shaped core halves which are connected together with their limbs facing each other so that they enclose a core window and each of which is constructed substantially from a packet of mutually parallel strips of amorphous ferro-magnetic material.

A core for such a device is known, for example, from JP.A-58-148 418 (See Patent Abstracts of Japan, Vol. 7, No. 267, p. 2E213). Such cores are also known as "C" or "U" cores. They may be formed, for example, by winding a ribbon of an amorphous ferromagnetic material (for example, one of the materials described in DE-A-2 546 676) about a winding mandrel until the desired number of turns has been reached, after which the core is annealed and is impregnated with a binder (for example, a suitable synthetic resin). The core is then severed into two C or U-shaped halves, for example, by means of a grinding tool. Said halves are then connected together with their limbs facing each other.

SUMMARY OF THE INVENTION

It has now been found that the effective magnetic permeability in such cores depends on the temperature. It is an object of the invention to provide an inductive device of the type mentioned in the opening paragraph the core of which has been improved to such an extent that the effective magnetic permeability is considerably less dependent on the temperature than in the known cores.

For that purpose the device according to the invention is characterized in that a filling member consisting of a solid, non-ferromagnetic material is placed between the free ends of each pair of facing limbs and in the space between the ends extends from the core window in the outward direction over at most half of the width of the limbs.

The invention is based on the recognition of the fact that in impregnated cores of an amorphous ferromagnetic material two thermal effects occur which are caused by the difference in expansion between the metal ribbon and the binder. The first effect is the occurrence of temperature-dependent mechanical stresses in the ribbon which influence the material properties, among which is the magnetic permeability. The second effect is a temperature-dependent variation in the shape of the core as a result of the said stresses. As a result of said variation in shape, variable air gaps are formed at the area where the limbs of the two core halves contact each other. Due to the measures according to the invention the said two effects have opposite results on the effective magnetic permeability: a reduction of the permeability of the material is associated with a reduction of the air gap so that the effective permeability in a given temperature range does not vary or varies only very slightly.

BRIEF DESCRIPTION OF THE DRAWINGS

The invention will now be described in greater detail with reference to the drawing, in which.

DESCRIPTION OF THE PREFERRED EMBODIMENTS

Figure 1:
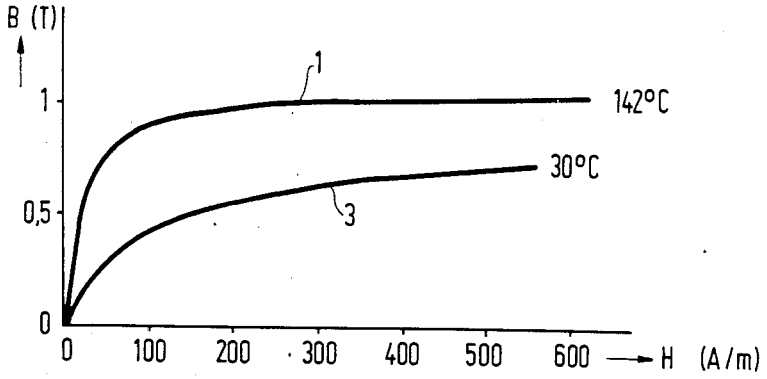
FIG. 1 is a graph showing the magnetization curves of an impregnated, non-severed core wound from a ribbon-shaped amorphous material at various temperatures.

In FIG. 1 the magnetic inductance B is shown as a function of the magnetic field strength H for a core which is wound from a ribbon-shaped amorphous ferromagnetic material and is impregnated with a binder, which core has not yet been severed into two halves, for example, a core as described in the document JP-A-58-148 418 mentioned hereinbefore or in the prior U.S. Pat. No. 4,635,018. In this case it is a core which is wound from a material having the type number 122-C of AKZO and has been annealed in nitrogen at a temperature of 430° C. for 210 minutes after winding. The core has then been impregnated with a binder, type No. Cy220/Hy227 of Ciba-Geigy which has been hardened at a temperature of 150° C. The material of the core then proves to be of low stress at a temperature of approximately 142° C. The difference between the low-stress temperature and the hardening temperature should presumably be ascribed to the shrinkage of the binder during the hardening. Curve 1 in FIG. 1 shows the variation of the inductance as a function of the field strength at the low-stress temperature of 142° C. and curve 3 shows the variation after the core has been cooled to 30° C. It is found that upon cooling the mechanical stresses in the core have become so high that a very high magnetic field strength is necessary to achieve an inductance of 1 Tesla. The magnetic permeability of the core material thus has decreased considerably during cooling.

Figure 2:
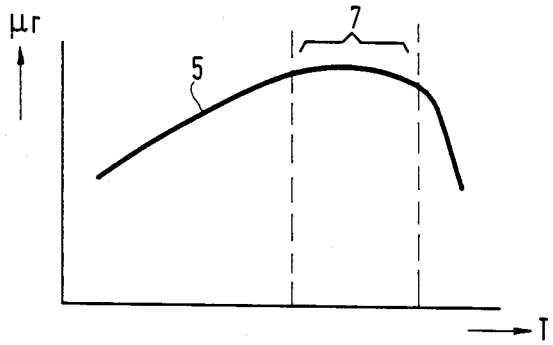
FIG. 2 is a graph showing the variation of the magnetic permeability of the material of such a core as a function of the temperature.

Curve 5 in FIG. 2 shows the variation of the magnetic permeability $\mu_r$ as a function of the temperature T. In the temperature range 7 shown between the broken lines (in this example approximately between 120° C. and 150° C.) the permeability is substantially independent of the temperature. Below said temperature range $\mu_r$ decreases gradually in agreement with what appears from FIG. 1. At higher temperatures the stress in the material also increases so that the permeability there decreases comparatively rapidly.

Figure 3:
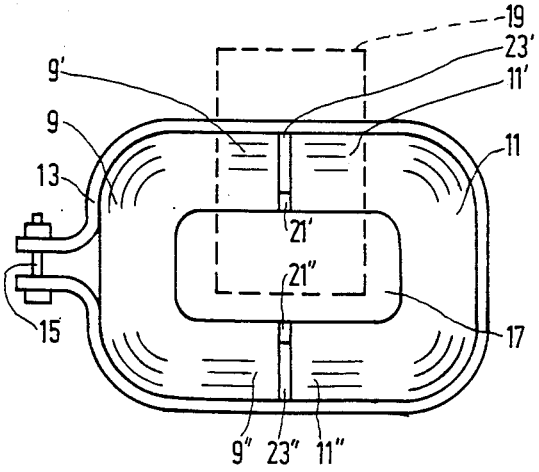
FIG. 3 is a diagrammatic side elevation of an embodiment of a device according to the invention.

FIG. 3 is a side elevation of an embodiment of an inductive device according to the invention. This device comprises a ferromagnetic core which consists of two U-shaped core halves 9 and 11 which are connected together with their limbs 9', 9'' and 11' and 11'', respectively, facing each other. The core halves are secured together by means of a preferably non-ferromagnetic band 13 which is clamped around the core halves by means of a bolt 15. The core halves 9 and 11 are constructed substantially from a packet of mutually parallel strips of an amorphous ferromagnetic material, for example, an iron alloy such as the said material of type number 122-C of AKZO. This material may be wound on the winding mandrel as described, for example, in the documents JP-A-58-148 418 and U.S. Pat. No. 4,635,018 mentioned hereinbefore (in the latter case the inner turn consists of a non-amorphous material, for example, silicon-iron). After winding, the core has been annealed in the usual manner, has then been impregnated and finally been severed into two halves 9 and 11. It is also possible to cut the core halves 9 and 11 from a packet of strips of amorphous material which has been bent in the form of a meander as described, for example, in DE-C 2 540 409.

The two core halves 9 and 11 which are connected together enclose a core window 17. A winding 19 which extends partly through the core window 17 is placed around the limbs 9' and 11' (shown in broken lines). The winding 19 may comprise one or more coils wound from electrically conductive wire or foil. It is, of course, also possible to provide a winding both around the limbs 9' and 11' and around the limbs 9'' and 11''.

Filling members 21' and 21'', respectively, consisting of a solid non-ferromagnetic material are placed between the free ends of each pair of facing limbs 9', 11' and 9'', 11'' near the core window 17. The filling members 21', 21'' extend into the spaces 23' and 23'', respectively, between the ends of the limbs 9', 11' and 9'' and 11'', respectively, from the core window 17 in the outward direction over at most half of the width of the limbs. The spaces 23' and 23'' constitute air gaps in the magnetic circuit which further consists of the core halves 9 and 11. The filling members 21', 21'' may consist of pieces of foil of a suitable synthetic resin, for example kapton. They may alternatively be formed by a projection at the inside of a coil former, (not shown) on which the winding 19 is present, in particular when a winding is provided around both pairs of limbs 9', 11' and 9'' and 11'', respectively. A coil former suitable for this purpose is disclosed in the prior U.S. patent application Ser. No. 879,699, now U.S. Pat. No. 4,737,755 (4/12/88).

The operation of the filling members 21', 21'' will be explained with reference to FIG. 4 which shows diagrammatically and on an enlarged scale the core halves 9, 11 at a temperature of approximately 30° C. As noted hereinbefore mechanical stresses have been formed in the core halves 9, 11 upon cooling from 150° C. (curing temperature of the binder), as a result of which variations in shape have occurred. As a result of this the limbs 9', 9'', 11'', 11', no longer are mutually in parallel. For reasons of clarity this is shown considerably exaggerated in the Figure. With respect to the stress-free condition the limbs 9', 9'', 11', 11'' are bent inwardly over an angle $\phi$ (in the direction of the core window 17). At the stress-free temperature (approximately 140° C.) the air gaps 23', 23'' everywhere had a width $d_s$ equal to the thickness of the filling members 21', 21''. In the condition shown the air gaps 23', 23'' are wedge-shaped, the width at the area of the outside of the filling members 21', 21'' being still equal to $d_s$. At the area of the inside of the air gap (near the core window 17) the width is equal to $d_s+2k\,\mathrm{tg}\,\phi$, where k is the width of the filling member 21', 21'', that is to say the distance over which the filling member extends from the core window in the outward direction. At the area of the outside of the air gap, the width of the air gap is equal to $d_s-2(h-k)\mathrm{tg}\,\phi$, where h is the width of the limbs 9', 9'', 11', 11''. The average width S of each air gap thus is equal to:

$$S = d_s + 2\left(k - \frac{h}{2}\right)tg\phi \tag{1}$$

When the overall length of the magnetic circuit is assumed to be equal to L, the length in the core material with a permeability $\mu_r$ is equal to L−2S and the length in the air gap having a permeability 1 is equal to 2S. In general it holds for a magnetic circuit having a length l and a permeability $\mu_r$ that:

$$B=\mu_r\mu_o H \tag{2}$$

$$H=nI/l \tag{3}$$

Herein n is the number of current-conveying turns surrounding the circuit and I is the current strength. From (2) and (3) it follows that:

$$nI = B\cdot\frac{1}{\mu_r\mu_o} \tag{4}$$

Figure 4:
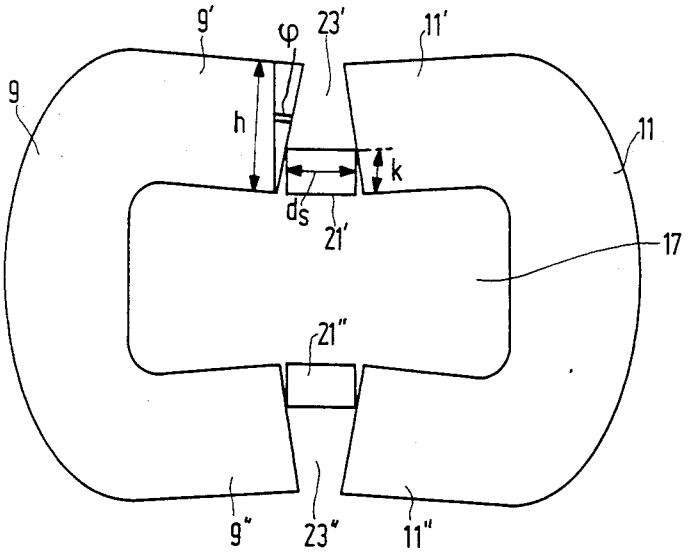
FIG. 4 is a side elevation on an enlarged scale of the core of the device shown in FIG. 3 for explaining the operation.

The circuit shown in FIG. 4 consists of a series arrangement of a first part with $l=L-2S$ and a permeability $\mu_r$ and a second part with $l=2S$ and a permeability 1. So for this it holds that:

$$nI = B\left(\frac{L-2S}{\mu_r\mu_o}+\frac{2S}{\mu_o}\right) \tag{5}$$

or:

$$B = \frac{nI}{\frac{L-2S}{\mu_r\mu_o}+\frac{2S}{\mu_o}} \tag{6}$$

In general, L>>S (for example, L=87 mm and $d_s$=0.1 mm) so that L−2S may be considered to be constant. As shown in FIG. 2, $\mu_r$ decreases when the temperature decreases, so that $$\frac{L-2S}{\mu_r\mu_o}$$

increases.

In order to keep the value of B approximately constant with a constant nI, $2S/\mu_o$ must thus decrease. That is to say that in (1) the term k−(h/2) should be negative or:

$k<(h/2)$

Figure 5:
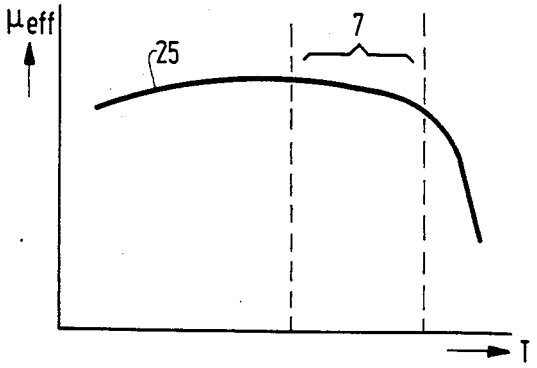
FIG. 5 is a graph showing the variation of the effective magnetic permeability of the core of the device shown in FIG. 3 as a function of the temperature.

The filling members 21', 21'' thus may extend into the spaces 23', 23'' from the core window 17 over at most half of the width of the limbs 9', 9'', 11', 11''. As appears from (1) and (6), the optimum value of k depends inter alia on the values of $\mu_r$ and tg $\phi$ (which are determined by the properties of the material) and on L, $d_s$ and h (which are also determined by the requirements of the design). The temperature during operation of the device is also of importance. The correct value of k in a concrete case, for example, will have to be established by calculation. For this purpose, the value of B at the stress-free temperature (for example, 140° C.) and at the minimum operating temperature (for example, 30° C.)

may be computed for various values k by means of (6) and (1). It proves to be possible to keep the value of B and hence the effective permeability $\mu_{eff}$ substantially constant in this manner for temperatures below the low-stress range 7, as is shown by curve 25 in FIG. 5.

What is claimed is:

1. An inductive device comprising a ferromagnetic core having two approximately U-shaped core halves fastened together with their limbs facing each other so that they enclose a core window and each of which is constructed substantially from a packet of mutually parallel strips of an amorphous ferromagnetic material by cutting it from a packet of strips formed by bending and stacking or by winding a longer strip of such material, characterized in that the core comprises means for decreasing the temperature-dependency of its effective magnetic permeability, said means comprising a filling member made of a solid, non-ferromagnetic material placed between free ends of each pair of facing limbs and in a space between the ends extends from the core window in the outward direction over at most half of the width of the limbs.

2. An inductor device comprising: a ferromagnetic core including first and second U-shaped sections fastened together with their limbs directed towards each other such that said first and second sections form a magnetic circuit interrupted by at least one air gap formed between facing ends of at least one pair of limbs, said first and second U-shaped sections forming an enclosed core window, each of said U-shaped core sections being formed from a packet of mutually parallel strips of an amorphous ferromagnetic material by cutting it from a packet of strips formed by bending and stacking or by winding a long strip of such material, and means for decreasing the temperature-dependency of the effective magnetic permeability of the core comprising a filling member made of a solid non-ferromagnetic material positioned between said facing ends of said at least one pair of limbs, said filling member extending from the core window in the outward direction over at most half of the width of the limbs, and coil means surrounding at least one of said limbs.

3. A method of making a core for an inductive device comprising the steps of:

winding a ribbon of an amorphous ferromagnetic material into a structure comprising a predetermined number of turns, annealing said structure at a predetermined temperature for a predetermined time, impregnating said structure with a binder material, cutting approximately U-shaped core halves from said structure, each core half comprising a packet of mutually parallel strips of said amorphous ferromagnetic material, fastening two U-shaped core halves together with their limbs facing each other so that they enclose a core window, characterized in that the method further comprises the step of placing a filling member made of a solid non-ferromagnetic material in the space between the free ends of each pair of facing limbs so that said member extends from the core window in the outward direction over at most half of the width of the limbs thereby to decrease the temperature-dependency of the effective magnetic permeability of the core.

4. A method of making a core for an inductor device comprising the steps of:

stacking a plurality of ribbons of an amorphous ferromagnetic material to form a packet, bending said packet to form a meander-shaped structure, annealing said structure at a predetermined temperature for a predetermined time, impregnating said structure with a binder material, cutting approximately U-shaped core halves from said structure, each core half comprising a packet of mutually parallel strips of said amorphous ferromagnetic material, fastening two U-shaped core halves together with their limbs facing each other so that they enclose a core window, characterized in that the method further comprises the step of placing a filling member made of a solid non-ferromagnetic material in the space between the free ends of each pair of facing limbs so that said member extends from the core window in the outward direction over at most half of the width of the limbs thereby to decrease the temperature-dependency of the effective magnetic permeability of the core.

* * * * *